US010865964B1

(12) United States Patent
Cheng

(10) Patent No.: US 10,865,964 B1
(45) Date of Patent: Dec. 15, 2020

(54) TRIM ASSEMBLY AND ITS SPRING STRUCTURE

(71) Applicant: Amline Products Ltd., Taipei (TW)

(72) Inventor: Shu-Hsiang Cheng, Taipei (TW)

(73) Assignee: AMLINE PRODUCTS LTD., Taipei (TW)

( * ) Notice: Subject to any disclaimer, the term of this patent is extended or adjusted under 35 U.S.C. 154(b) by 0 days.

(21) Appl. No.: 16/427,408

(22) Filed: May 31, 2019

(51) Int. Cl.
*F21V 21/04* (2006.01)
*F21V 17/16* (2006.01)

(52) U.S. Cl.
CPC ..... *F21V 17/16* (2013.01)

(58) Field of Classification Search
None
See application file for complete search history.

(56) References Cited

U.S. PATENT DOCUMENTS 4,408,804 A * 10/1983 Marshall, Jr. ..... B60B 7/10 301/37.31
2018/0202623 A1* 7/2018 Nguyen ..... F21V 21/26

* cited by examiner

*Primary Examiner* — Elmito Breval
(74) *Attorney, Agent, or Firm* — Bacon & Thomas, PLLC

(57) ABSTRACT

A trim assembly adapted to be mounted in an engaged assembly includes a spring fixing part and a first contact spring. The spring fixing part protrudes from a trim base of the trim assembly and adapted to be inserted into a containing part of the engaged assembly. The first contact spring is connected to the spring fixing part and adapted to abut on an inner wall of the containing part. The first contact spring includes a connecting part, an abutting part, and an extending arm. The connecting part is connected to the spring fixing part. The abutting part bends from a terminal of the connecting part and extends to form a first abutting face. The extending arm has a second abutting face and extends from a side of the first abutting face.

16 Claims, 9 Drawing Sheets

TRIM ASSEMBLY AND ITS SPRING STRUCTURE

BACKGROUND OF THE INVENTION

1. Field of the Invention

The present invention relates to a trim assembly and its spring structure and particularly to be mounted in an engaged assembly.

2. Description of Related Art

Typically, an appliance having an engaged assembly (e.g. a housing or a recess), such as a lighting fixture, is usually decorated by a trim combined with the engaged assembly. The trim can not only protect the components inside the appliance, but also enhance the visual aesthetic of the appliance.

However, a user often faces some problems when removing the trim mounted in the engaged assembly of the appliance. In a prior art, when the appliance is on a ceiling, the trim is often tightly fastened to the engaged assembly, so as to prevent the trim from dropping from the ceiling. The tight fastening increases the possibility of damaging the appliance or the objects adjacent to the appliance when the trim is removed from the engaged assembly. Besides, when a natural disaster (e.g. earthquake) happens, the trim or the components of the appliance may drop and cause danger because of the violent shaking. In addition, the tight fastening increases the difficulty of rotating the trim engaging with the engaged assembly, it may cause inconvenience when the direction of the trim in the appliance needs to be regulated. In addition, some recessed structures have no corresponding trim.

Therefore, there is a need to provide an improved trim assembly, so as to solve the aforementioned problems.

SUMMARY OF THE INVENTION

The present invention provides a trim assembly with an improved spring structures, so that the trim assembly can be easily removed from the engaged assembly. Besides, the improved trim structure can also enhance the abutment between the trim assembly and the engaged assembly. In addition, the trim assembly of the invention can have better engaging ability than that of the typical trim by using a few spring assemblies of the invention.

An object of the present invention is to provide a trim assembly for being mounted in an engaged assembly. The trim assembly includes a spring fixing part and a first contact spring. The first contact spring is connected to the spring fixing part and adapted to abut on an inner wall of a containing part of the engaged assembly. The first contact spring includes a connecting part, an abutting part, and an extending arm. The connecting part is connected to the spring fixing part. The abutting part bends from a terminal of the connecting part and extends to form a first abutting face. The extending arm has a second abutting face and extends from a side of the first abutting face.

Another object of the present invention is to provide spring structure that allows a trim assembly to be mounted into a containing part of an engaged assembly. The spring structure includes a first contact spring adapted to abut on an inner wall of the containing part. The first contact spring includes a connecting part, an abutting part, and an extending arm. The connecting part is connected to a spring fixing part of the trim assembly. The abutting part bends from a terminal of the connecting part and extends to form a first abutting face. The extending arm has a second abutting face and extends from a side of the first abutting face.

DETAILED DESCRIPTION OF THE EMBODIMENTS

It is to be noted that, any description hereinafter using "when . . . " or "at the time of . . . " is intended to include a time "concurrent to, before, or after" the thing indicated by either of the two phrases happens. Besides, when there are more than one effects recited in association with one element, component or assembly, as long as these effects are conjoined by the term "or", any of these effects may be exist independently, but it does not exclude the possibility of coexistence of the effects. Moreover, in the specification and the claims, the recitation of "a particular operation executed by a unit" means the unit may not only execute the particular operation, but also execute other operations.

Furthermore, the use of the ordinal numbers such as "first", "second", etc. in the specification and the claims to describe the elements do not imply that another element with a smaller number must exist before one element with a greater number. The ordinal numbers do not represent the order between one element and another element, or the order of a manufacturing method. These ordinal numbers are used only to clearly distinguish one element having a certain name from another element having the same name.

In order to clearly describe the detail of the invention, the following embodiments are exemplified by the case that the invention is used in a light fixture, e.g. the trim assembly and the engaged assembly are used in the light fixture. However, the invention may be used in other appliances having the trim and the engaged assembly, e.g. a box structure having a body and a top cover engaging with the body, if appropriate.

Besides, for the convenience of description, each direction parallel to a disposing surface of the trim assembly is defined hereinafter as a "horizontal direction", and each direction perpendicular to the disposing surface is defined hereinafter as a "vertical direction".

Figure 1:
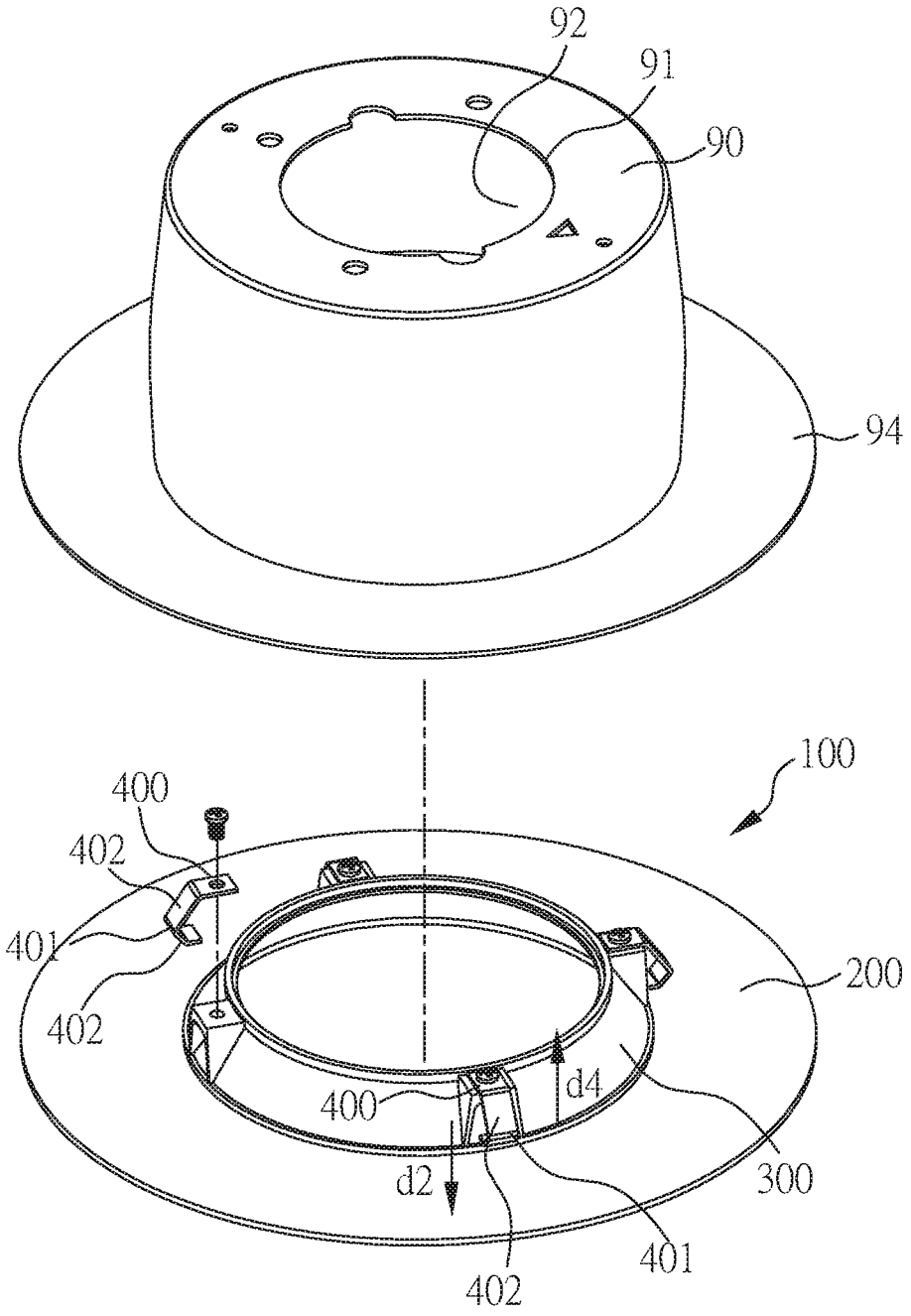
FIG. 1 is a schematic diagram of a typical trim assembly and an engaged assembly according to a conventional product.

FIG. 1 is a schematic diagram of a typical trim assembly 100 and an engaged assembly 90 according to a conventional product. As shown in FIG. 1, the typical trim assembly 100 includes a trim base 200, a spring fixing part 300, and at least four typical springs 400. The engaged assembly 90 includes a containing part 91 and an engaged assembly base 94. The containing part 91 has an inner wall 92 and a central opening corresponding to a shape of the spring fixing part 300, so that the spring fixing part 300 can be inserted into the containing part 91. When the spring fixing part 300 is inserted into the containing part 91, the trim base 200 will contact the engaged assembly base 94 with the typical springs 400 abutting on the inner wall 92.

In this example, the engaged assembly 90 may be a housing, but the engaged assembly 90 may also be a recessed structure or other structure for being engaged. In this example, the spring fixing part 300 may be a trim collar of the trim assembly 100, but in other examples, the spring fixing part 300 may be other components of the trim assembly 100, or may be defined as a position on the trim assembly 100.

The typical springs 400 are locked on the spring fixing part 300. Each typical spring 400 has a bending structure bended away from the spring fixing part 300. A bending central of each typical spring 400 is defined as a bending terminal 401. When the spring fixing part 300 is inserted into the containing part 91, the bending terminal 401 will abut on the inner wall 92, and the typical trim assembly 100 is then mounted in the engaged assembly 90.

Besides, each typical spring 400 has two extending units 402, one protrudes from the bending terminal 401 and substantially extends along a first vertical direction d2, and the other one protrudes from the bending terminal 401 and substantially extends along a second vertical direction d4. It is said that, the extending units 402 substantially extend along the vertical direction. Herein, "substantially extend along the vertical direction" means an acute angle exists between the extending direction and the vertical direction.

It should be noted that, each extending unit 402 has a smooth surface, and the left terminal and the right terminal (based on the local reference of FIG. 1) of the bending terminal 401 are regarded as two sharp terminals in a horizontal direction. Thus, when the typical spring 400 engages with the engaged structure 90, it is difficult to rotate the trim assembly 100 in the horizontal direction. But if an enough pulling force (e.g. greater than the engaging force) along the first vertical direction d2 is applied thereto, the trim assembly can be moved along the first vertical direction d2.

It can be understood that, the typical spring 400 abuts tightly against the inner wall 92 through the bending terminal 401, and as a result, it is almost impossible to rotate the typical trim assembly 100 in the engaged assembly. When a user tries to remove the typical trim assembly 100 from the engaged assembly 90, the user has to apply a great vertical force to pull down the typical trim assembly from the engaged assembly 90. Therefore, the typical spring 400 is inconvenient, and the surrounding may be damaged when the typical trim assembly 100 is removed. Besides, the typical trim assembly 100 may fall off when it is violently shaken. On the contrary, the invention can solve the problems as will be discussed in the following description.

Figure 2:
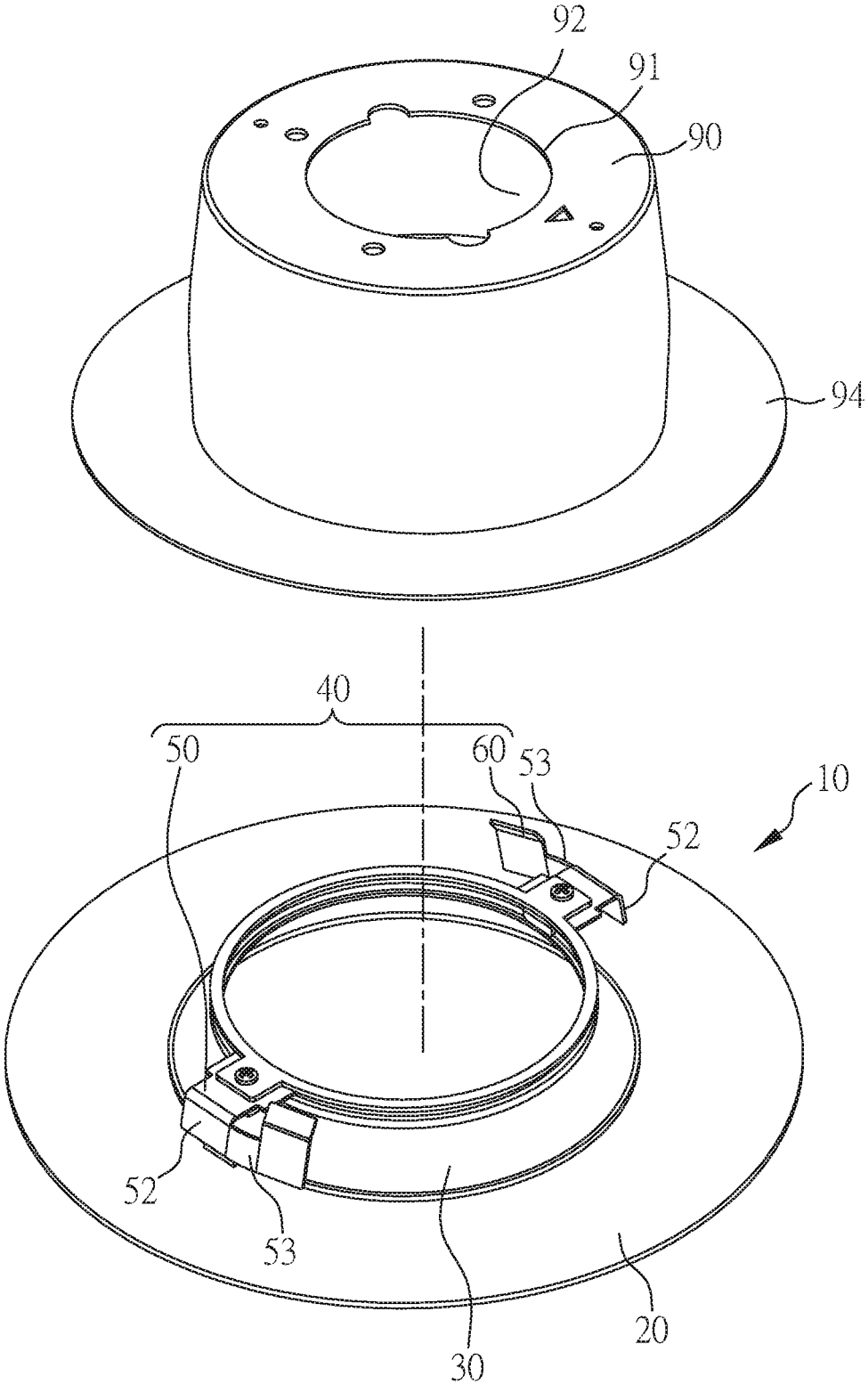
FIG. 2 is a schematic diagram of the trim assembly and the engaged assembly according to an embodiment of the invention.

FIG. 2 is a schematic diagram of the trim assembly 10 and the engaged assembly 90 according to an embodiment of the invention. As shown in FIG. 2, the trim assembly 10 includes a trim base 20, a spring fixing part 30, and a spring structure 40. The spring fixing part 30 is a part of the trim assembly 10 for being connected with the spring structure 40. In an embodiment, the spring fixing part 30 may be a trim collar, but not limited thereto. When the spring fixing part 30 is the trim collar, it may protrude perpendicularly from a surface of the trim base 20, and is used to be inserted into the containing part 91 corresponding to a shape of the spring fixing part 30. Herein, the containing part 91 has a suitable shape and size, so that it can be contained in the spring fixing part 30. The spring structure 40 includes at least a first contact spring 50. The first contact spring 50 is connected with the spring fixing part 30, and abuts on the inner wall 92 of the containing part 91. The first contact spring 50 can enable the trim assembly 10 to engage with the engaged assembly 90, and can prevent the trim assembly 10 from swaying in the engaged assembly 90. In an embodiment, the spring structure 40 includes at least two contact springs, e.g. a first contact spring 50 and a second contact spring 60.

One feature of the invention is the novel spring structure 40. The first contact spring 50 and the second contact spring 60 have significantly different structures from the typical spring 400 in FIG. 1, and thus the invention can provide different effects to compensate the disadvantage of the typical spring 400.

In an embodiment, the trim base 20 and the engaged assembly 90 may have any shape. In an embodiment, the spring fixing part 30 and the containing part 91 may have a circle shape or a ring shape, but not limited thereto.

In an embodiment, the first contact spring 50 or the second contact spring 60 may be made of metal or plastic. In an embodiment, the first contact spring 50 or the second contact spring 60 may be made of at least one elastic material. In an embodiment, the first contact spring 50 or the second contact spring 60 may be made of steel, copper, plastic, or their combinations, but is not limited thereto. In an embodiment, the first contact spring 50 and the second contact spring 60 may be made of different materials.

Figure 3A:
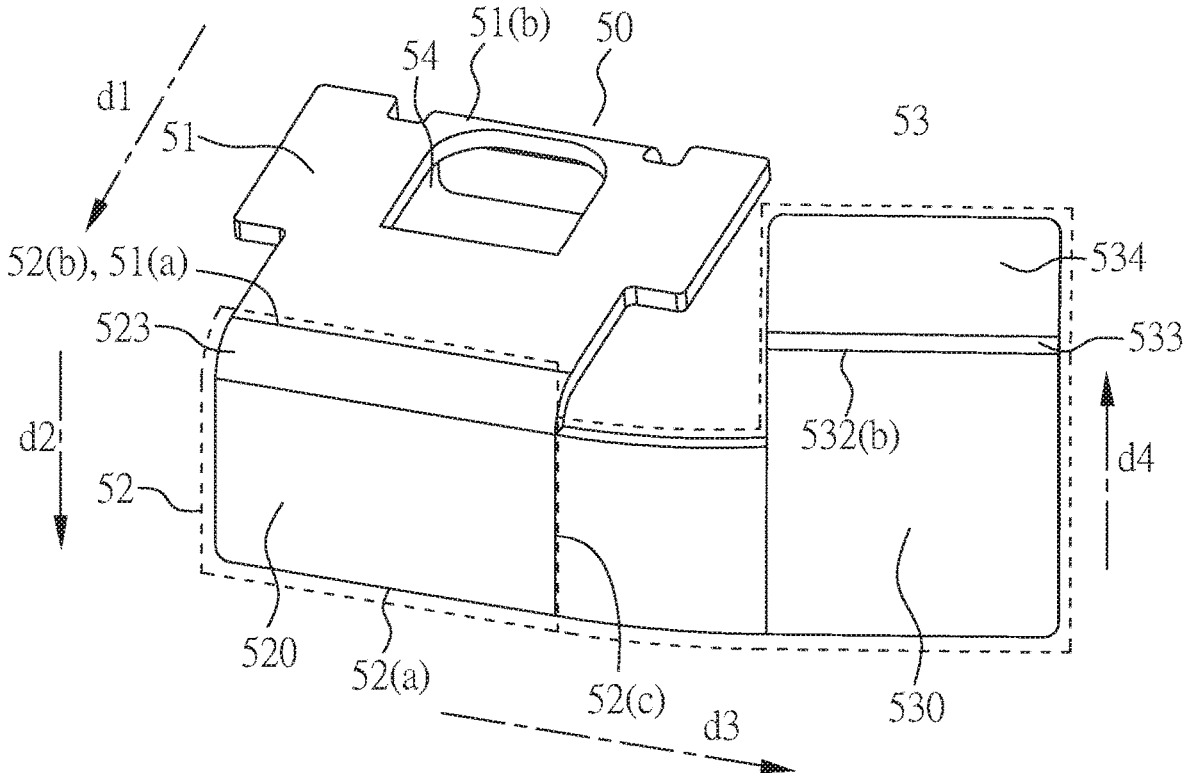
FIG. 3(A) is a perspective view of the first contact spring according to an embodiment of the invention.
Figure 3B:
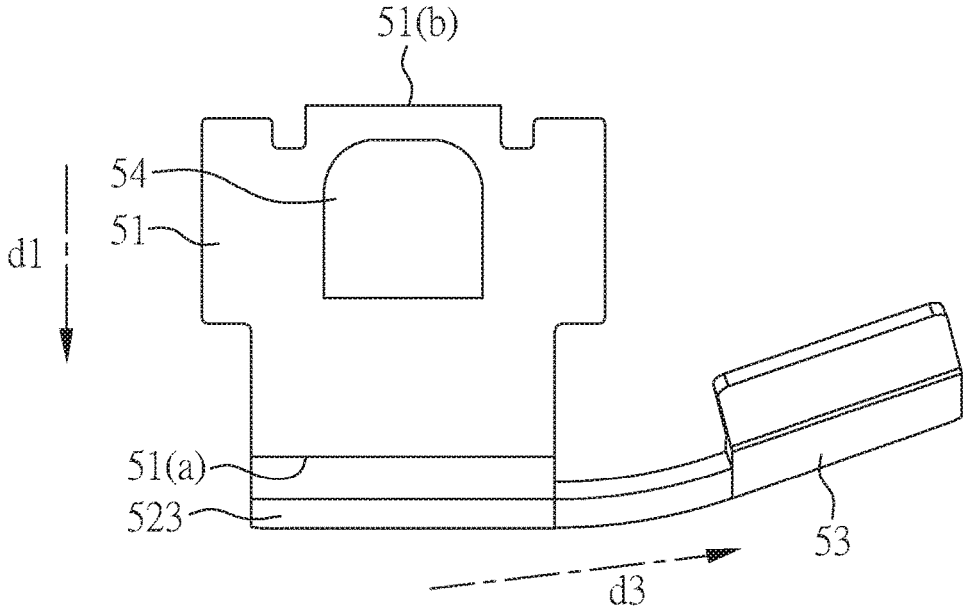
FIG. 3(B) is a top view of the first contact spring according to an embodiment of the invention.
Figure 3C:
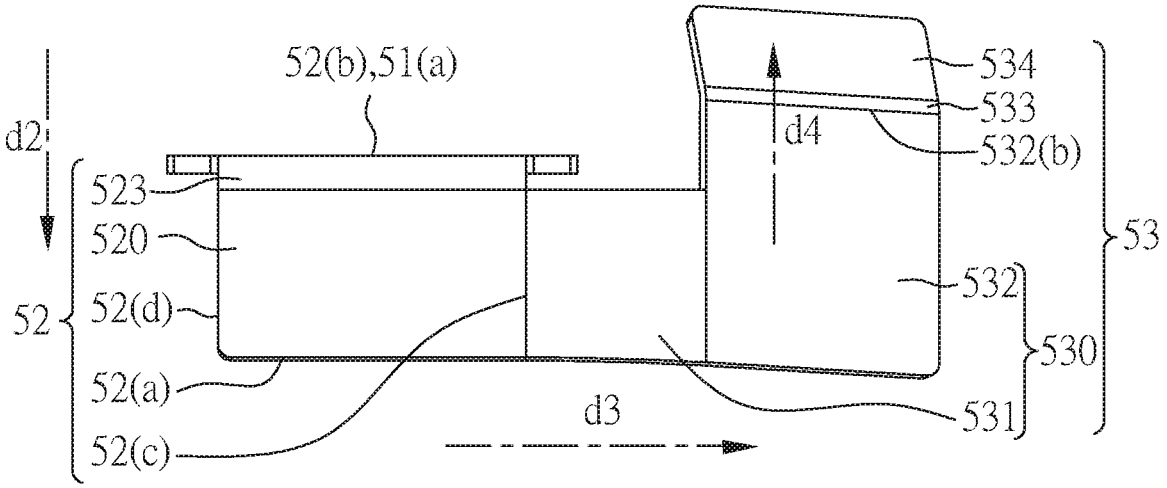
FIG. 3(C) is a front perspective view of the first contact spring according to an embodiment of the invention.
Figure 3D:
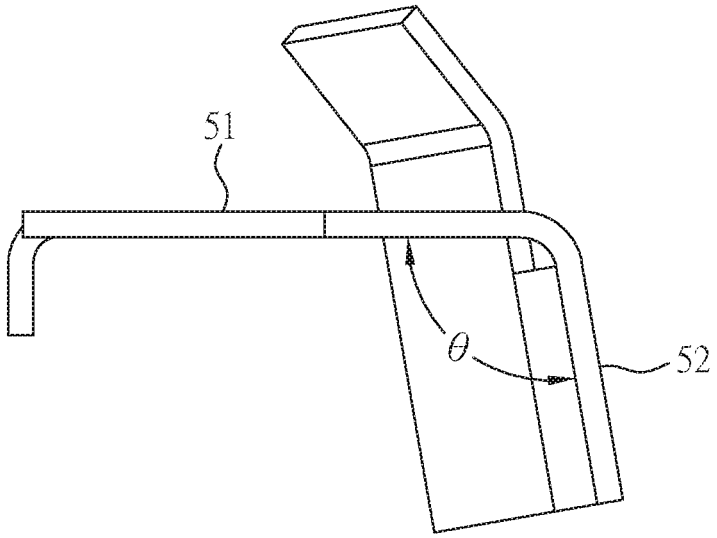
FIG. 3(D) is a schematic diagram of detailed features of the first contact spring according to an embodiment of the invention.
Figure 3E:
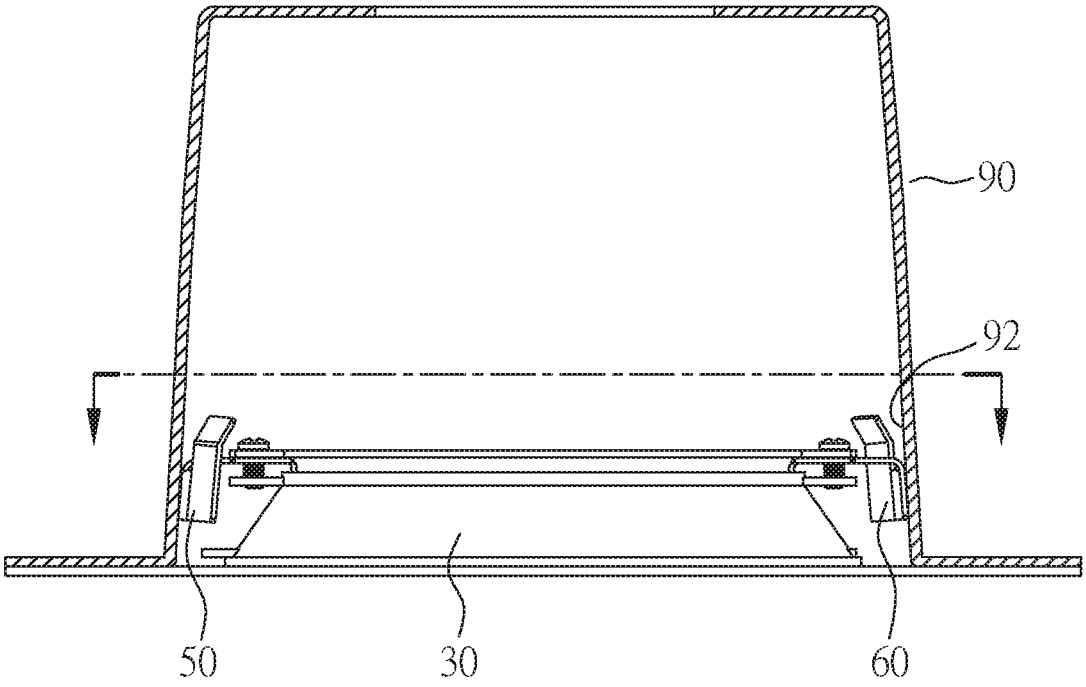
FIG. 3(E) is a sectional view of the trim assembly and the engaged assembly according to an embodiment of the invention.
Figure 3F:
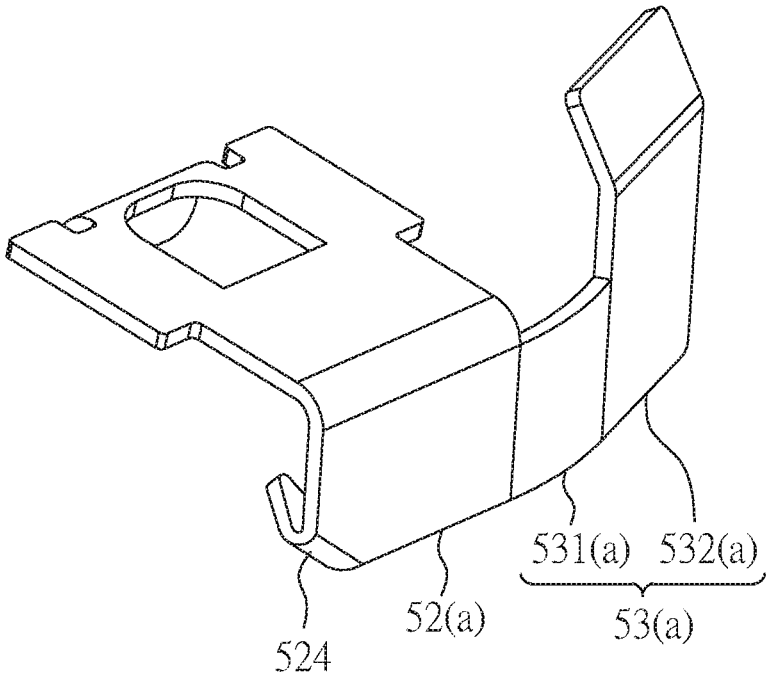
FIG. 3(F) is a side view of the first contact spring according to an embodiment of the invention.

The details of the first contact spring 50 will be discussed in the following description. Referring to FIG. 2 and FIGS. 3(A) to 3(E) together, FIG. 3(A) is a perspective view of the first contact spring 50 according to an embodiment of the invention, FIG. 3(B) is a top view of the first contact spring 50 according to an embodiment of the invention, FIG. 3(C) is a front perspective view of the first contact spring 50 according to an embodiment of the invention, FIG. 3(D) is a schematic diagram of detail features of the first contact spring 50 according to an embodiment of the invention, FIG. 3(E) is a sectional view of the trim assembly 10 and the engaged assembly 90 according to an embodiment of the invention, and FIG. 3(F) is a side view of the first contact spring 50 according to an embodiment of the invention. The engaged assembly 90 mentioned in the following description is shown in FIG. 2. The structure of the second contact spring 60 may correspond to that of the first contact spring 50. For example, the first contact spring 50 and the second contact spring 60 may have similar components. However, they may have different arrangements of the components. A person having ordinary skill in the art can realize the structure of the second contact spring 60 from the description of the structure of the first contact spring 50.

As shown in FIG. 3(A), the first contact spring 50 includes a connecting part 51, an abutting part 52, and an extending arm 53. Similarly, the second contact spring 60 (see FIG. 2) also includes the connecting part, the abutting part, and the extending arm.

The connecting part 51 is connected to the spring fixing part 30. In an embodiment of FIGS. 2, 3(A) and 3(B), a lock hole 54 exists on the connecting part 51. A lock component (e.g. a screw) can pass through the lock hole 54 to lock the connecting part 51 on the spring fixing part 30, thereby connecting the first contact spring 50 to the spring fixing part 30. In an embodiment, the connecting part 51 may have a planar structure (substantially) extending along a first horizontal direction d1. The first horizontal direction d1 is defined as a direction extending away from the spring fixing part 30 when the connecting part 51 is connected to the spring fixing part 30. In another embodiment, the connecting part 51 may have a non-planar (e.g. curved) structure. Besides, when the connecting part 51 is connected to the spring fixing part 30, an edge of the connecting part 51 farthest from the spring fixing part 30 is defined as a connecting part end terminal 51(*a*), and another edge of the connecting part 51 closest to the spring fixing part 30 is defined as a connecting part start terminal 51(*b*).

The abutting part 52 bends from the connecting part end terminal 51(*a*), and (substantially) extends along a first vertical direction d2 to form a first abutting face 520. The first vertical direction d2 is different from the first horizontal direction d1, e.g. the first vertical direction d2 is perpendicular to the first horizontal direction d1, but not limited thereto. At least a part of the first abutting face 520 abuts on the inner wall 92. The first abutting face 520 may have a planar structure, but it may also be a non-planar (e.g. curved) structure. In an embodiment, a bending part between the first abutting face 520 and the connecting part 51 is defined as a first bending part 523. The first bending part 523 may be designed to be an arc or an angle.

As shown in FIGS. 3(A) and 3(C), the first abutting face 520 has a first abutting face bottom terminal 52(*a*) away from the connecting part 51, a first abutting face top terminal 52(*b*) close to the connecting part 51, and two opposite side edges 52(*c*) and 52(*d*). The extending arm 53 protrudes from one of the side edges 52(*c*) and 52(*d*) of the first abutting face 520, and (substantially) extends along a second horizontal direction d3 to form a second abutting face 530. The second horizontal direction d3 may be perpendicular both to the first horizontal direction d1 and the first vertical direction d2, but not limited thereto.

It is noted that, except for a part connected to the abutting part 52, other parts of the extending arm 53 are suspended in midair, e.g. when the first contact spring 50 is connected to the spring fixing part 30, a free space exists (or is preserved) between the extending arm 53 and the spring fixing part 30. Since the extending arm 53 is formed of the elastic material, when a specific amount of (horizontal) force is applied to the extending arm 53, the free space will be transformed to allow the extending arm 53 to move toward the spring fixing part 30.

At least a part of the second abutting face 530 abuts on the inner wall 92. In an embodiment, the second abutting face 530 has a planer structure, but it may also have a non-planer (e.g. curved) structure. When the trim assembly 10 mounted in the engaged assembly 90 remains still, at least a part of the first abutting face 520 and at least a part of the second abutting face 530 both abut on the inner wall.

The extending arm 53 of the first contact spring 50 extends along the horizontal direction (e.g. the second horizontal direction d3), and the second abutting face 530 has the smooth face, so the trim assembly 10 can be rotated along the horizontal direction easily. Besides, when the trim assembly 10 engages with the engaged assembly 90, the top terminals and the bottom terminals (based on the directions of FIGS. 3(A) and 3(C)) of the first abutting face 52 and the extending arm 53 of the first contact spring 50 are sharp terminal in the vertical direction, thus the move of the first abutting face 52 of the first contact spring 50 along the vertical direction can be blocked. It is said that, comparing with the typical spring 400 of FIG. 1, the first contact spring 50 has greater engaging ability (e.g. can provide the greater tensile force) in the vertical direction.

In an embodiment, when the horizontal force (either clockwise or counterclockwise) is applied to the trim assembly 10 mounted in the engaged assembly 90, the free space will be reduced, and a frictional force between the abutting part 52 and the inner wall 92 will be different from a friction force between the extend part 53 and the inner wall 92, e.g. the friction force between the extend part 53 and the inner wall 92 will be smaller than the friction force between the abutting part 52 and the inner wall 92. The abutment is accordingly loosened, and the extending arm 53 extending along the horizontal direction has the smooth face, the trim assembly 10 can thus be rotated in the engaged assembly 90.

In an embodiment, a longer length of the extending arm 53 extending along the second horizontal direction d3 makes it easier to rotate the trim assembly 10 in the housing 90.

It can be seen that, the invention allows the trim assembly 10 to be rotated along the horizontal direction (or circularly) after being mounted in the engaged assembly 90. Advantageously, a user can adjust the trim assembly 10 in the engaged assembly 90 easily by rotating the trim assembly 10 directly in the engaged assembly 90, without pulling down it from the engaged assembly 90.

Besides, to discuss the detailed properties of the frictional forces occurring in the prior art and the invention, respectively, the frictional force in the prior art is caused by an area contact, while the frictional force in the invention can be reduced because it is caused by a line contact during the rotation. With the frictional force reduced, it is easier to remove the trim assembly 10 from the engaged assembly 90 according to the invention.

In addition, in an embodiment, the second abutting face 530 includes a connecting face 531 and an enlarged face 532. The enlarged face 532 may be greater than the connecting face 531. The connecting face 531 is connected to the first abutting face 520. When measured along the first vertical direction d2, the connecting face 531 has a side edge of which the length is equal to the length of the side edge 52(*c*) of the first abutting face 520. The enlarged face 532 is connected to the connecting face 531, and extends along the second vertical direction d4. The second vertical direction d4 may extend opposite to the first vertical direction d2. Besides, in an embodiment, a top terminal 532(*b*) of the enlarged face 532 is connected to a second bending part 533. The second bending part 533 serves as an angular guide that guides the trim assembly 10 into the engaged assembly 90.

In an embodiment, when the trim assembly 10 is mounted in the engaged assembly 90, the first abutting face 520 and the second abutting face 530 both contact the inner wall 92. In comparison, the engaging ability of the spring structure of the invention is greater than the typical spring structure. In other aspect, when providing equal abutment between the trim assembly 10 and the engaged assembly 90, the invention only needs a less number of the springs than the prior art does, which means the cost for manufacturing the light fixture (or other appliances having the engaged assembly) can be reduced.

In an embodiment, when there is a horizontal force but no vertical force applied to the trim assembly 10, the frictional force between the second abutting face 530 and the inner wall 92 can be reduced, and the trim assembly 10 can be rotated in a horizontal plane. However, the trim assembly 10 can remain in its original position along the vertical direction, without being detached from the engaged assembly 90, thanks to the enough abutment provided by the first abutting face 520.

Accordingly, as shown in FIGS. 2 and 3(E), the abutting part 52 and the extending arm 53 of the first contact spring 50 and the abutting part 62 and the extending arm 63 of the second contact spring 60 both contact the inner wall 92. The abutment can further be improved when the abutting parts 52, 62 and the extending arms 53, 63 are getting tighter to the inner wall 92. Besides, as shown in FIGS. 2 and 3(D), the connecting part 51 and the abutting part 52 extend along different directions, and a first angle θ1 is formed between the connecting part 51 and the abutting part 52. In an embodiment, a degree of the first angle θ1 is related to a frictional force between the first contact spring 50 and the inner wall 92.

When the trim assembly 10 is mounted in the engaged assembly 90, the first abutting face 520 and the second abutting face 530 can abut tighter against the inner wall 92 by setting a greater first angle θ1 to provide greater frictional force between the first contact spring 50 and the inner wall 92. In an embodiment, the first angle θ1 is at least 90 degrees, but not limed thereto.

Besides, the length of the connecting part 51 and the abutting part 52 in their extending directions (d1 and d2) can affect the engaging effect between the first contact spring 50 and the inner wall 92. In an embodiment, when the length of the connecting part 51 is increased, the engaging effect can be enhanced. In an embodiment, when the length of the abutting part 52 is increased, the engaging effect is enhanced. In addition, the radian of the curved structure of the extending arm 53 can affect the engaging effect between the first contact spring 50 and the inner wall 92. In an embodiment, when the radian is increased, the engaging effect can be enhanced. Further, as shown in FIGS. 2 and 3(F), the abutting part 52 includes an end terminal bending part 524. The end terminal bending part 524 bends from an end terminal of the abutting part 52 (e.g. a corner of the first abutting face 520), and extends toward the spring fixing part 30. In other words, the end terminal bending part 524 bends from the corner of the first abutting face 520, and extends opposite to the first horizontal direction d1. Forming the end terminal bending part 524 of the first abutting face 520 reduces the length (along a horizontal direction) of the first abutting face end terminal 52(*a*). A horizontal force and a vertical force may be applied simultaneously to detach the trim assembly 10 mounted in the engaged assembly 90. The horizontal force is applied to rotate the trim assembly 10 in the engaged assembly 90, and thus reduce the frictional force between the first abutting face 520 and the inner wall 92. The vertical force is applied to pull down the trim assembly 10 from the engaged assembly 90. With the frictional force reduced, it is easier for a user to remove the trim assembly 10 from the engaged assembly 90, without too much vertical force. It can be understood that, the invention is safer in use, because it does not require a great pulling force.

Figure 3G:
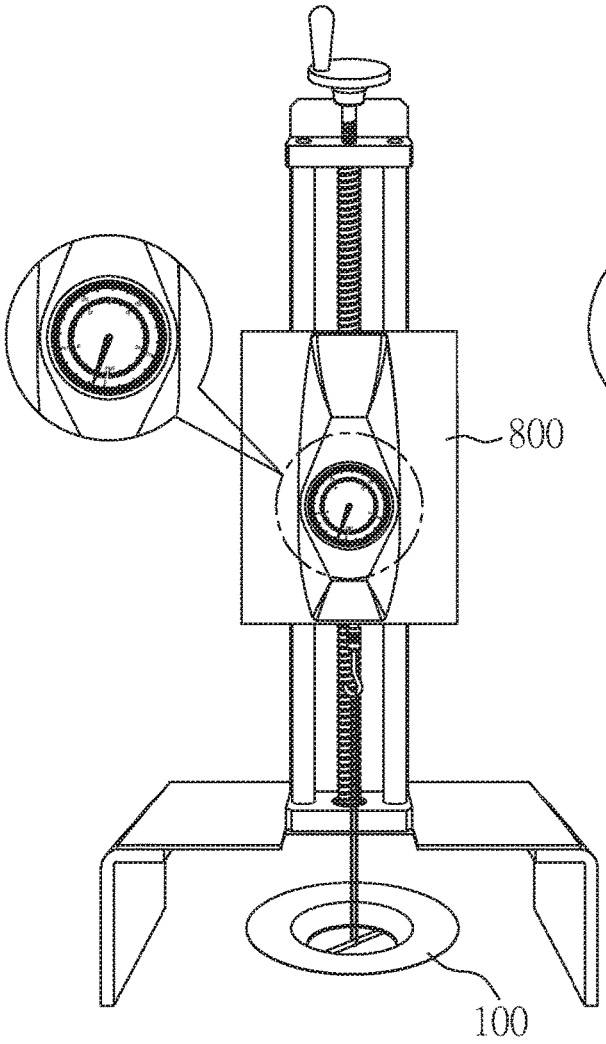
FIG. 3(G) is a schematic diagram illustrating an experiment of the tensile force test of the typical trim assembly of FIG. 1.
Figure 3H:
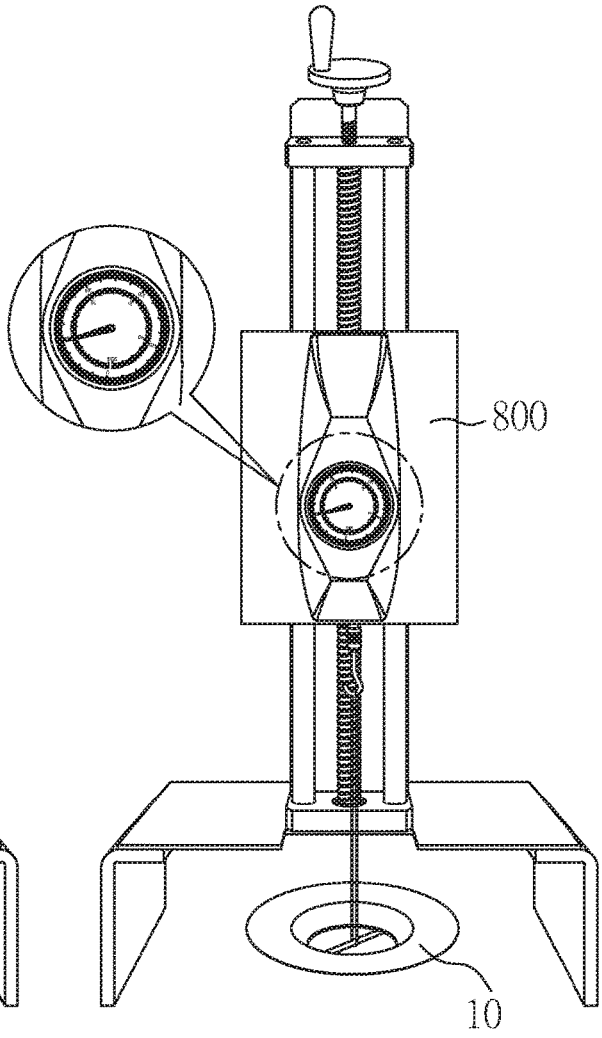
FIG. 3(H) is a schematic diagram illustrating an experiment of the tensile force test of the trim assembly of FIG. 2.

FIG. 3(G) is a schematic diagram illustrating an experiment of the tensile force test of the typical trim assembly 100 of FIG. 1, and FIG. 3(H) is a schematic diagram illustrating an experiment of the tensile force test of the trim assembly 10 of FIG. 2, wherein the typical trim assembly 100 has four typical springs 400, and the trim assembly 10 has two improved spring 40. Besides, in the experiments, the difference between the typical trim assembly 100 and the trim assembly 10 is only the springs 400 and 40, and the experiments are executed by a tensile tester 800.

As shown in 3(G), the typical trim assembly 100 having the four typical springs 400 can provide a tensile force with 2 kilogram (kg). As shown in 3(H), the trim assembly 10 having the two improved springs 40 can provide a tensile force with 10 kilogram (kg). It can be understood that, the improved springs 40 can provide a greater tensile force than that of the typical springs 400. Thus, comparing with the prior art, the trim assembly 10 of the invention can provide a greater tensile force while using less springs 40.

Figure 4A:
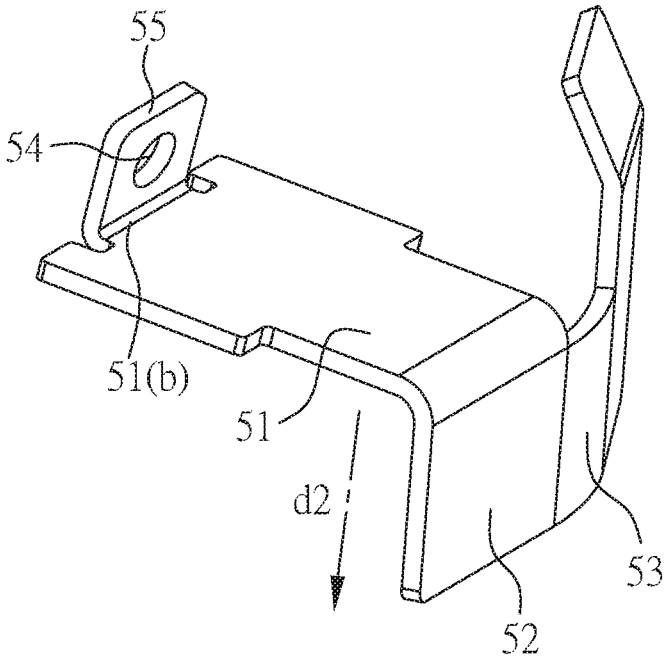
FIG. 4(A) is a schematic diagram of the first contact spring according to another embodiment of the invention.

It is possible to change the structure of the first contact spring 50. FIG. 4(A) is a schematic diagram of the first contact spring 50 according to another embodiment of the invention. As shown in FIG. 4(A), the first contact spring 50 further includes a lock part 55. The lock part 55 is connected to the connecting part start terminal 51(*b*), and extends (substantially) perpendicular to the connecting part 51. Besides, the lock hole 54 is disposed on the lock part 55 instead of the connecting part 51.

In this embodiment, the lock part 55 extends upward from the connecting part start terminal 51(*b*), i.e. along the second vertical direction d4. However, in an alternative embodiment, the lock part 55 may extend downward from the connecting part start terminal 51(*b*), i.e. along the first vertical direction d2), but not limited thereto.

Figure 4B:
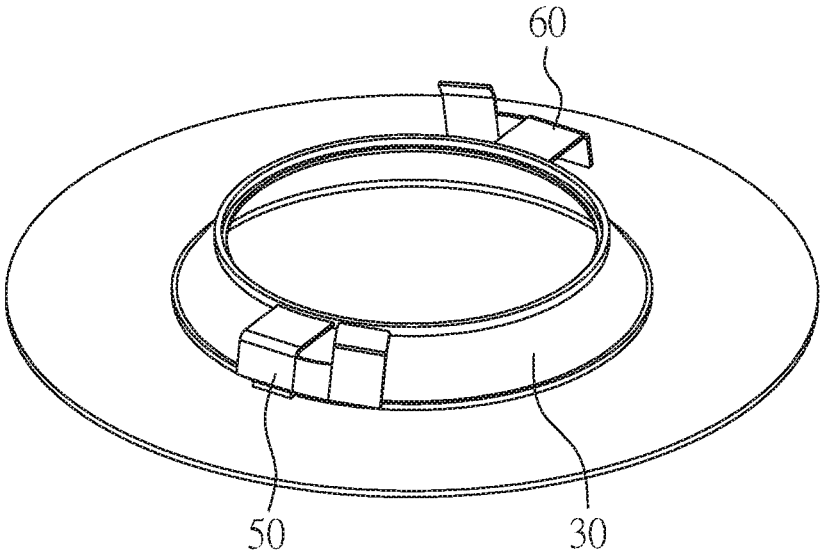
FIG. 4(B) is a schematic diagram of the trim assembly according to another embodiment of the invention.

It is also possible to change the structures of the first contact spring 50 and the spring fixing part 30. FIG. 4(B) is a schematic diagram of the trim assembly 10 according to another embodiment of the invention. As shown in FIG. 4(B), the first contact spring 50 and the spring fixing part 30 may be formed integrally. In this case, there is no the lock hole 54 existing in the first contact spring 50. An integrated form in the invention means a situation wherein two units are non-removed connected to each other, either made of the same material or different materials, but not limited thereto.

Typically, the second contact spring 60 may be implemented according to the structures of the first contact springs 50 in FIGS. 4(A) and 4(B).

Figure 5:
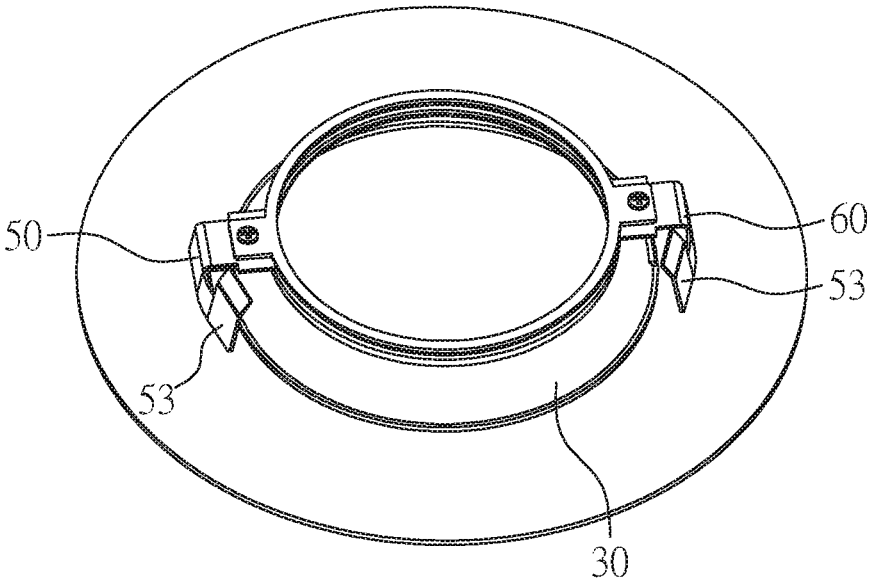
FIG. 5 is a schematic diagram of the trim assembly according to another embodiment of the invention.

The first contact spring 50 and the second contact spring 60 may be implemented in different ways. Referring both to FIGS. 2 and 5, FIG. 5 is a schematic diagram of the trim assembly 10 according to another embodiment of the invention. When the first contact spring 50 and the second contact spring 60 are connected to the spring fixing part 30, a position of the first contact spring 50 on the spring fixing part 30 and a position of the second contact spring 60 on the spring fixing part 30 are symmetrical to each other, i.e. the first contact spring 50 and the second contact spring 60 may be disposed on two opposite sides of the spring fixing part 30, but not limited thereto.

In the embodiment of FIG. 2, the second contact spring 60 and the first contact spring 50 have the same structure. In this case, when the first contact spring 50 and the second contact spring 60 are disposed on the two opposite sides of the spring fixing part 30, the extending arm 53 of the first contact spring 50 and the extending arm 63 of the second contact spring 60 extend along opposite directions. In the embodiment of FIG. 5, the second contact spring 60 has a structure corresponding to a structure of the first contact spring 50, but the extending arm 53 of the first contact spring 50 and the extending arm 63 of the second contact spring 60 extend toward different directions. In this case, when the first contact spring 50 and the second contact spring 60 are disposed on the opposite two sides of the spring fixing part 30, the extending arm 53 of the first contact spring 50 and the extending arm 63 of the second contact spring 60 extend along the same direction.

Figure 6:
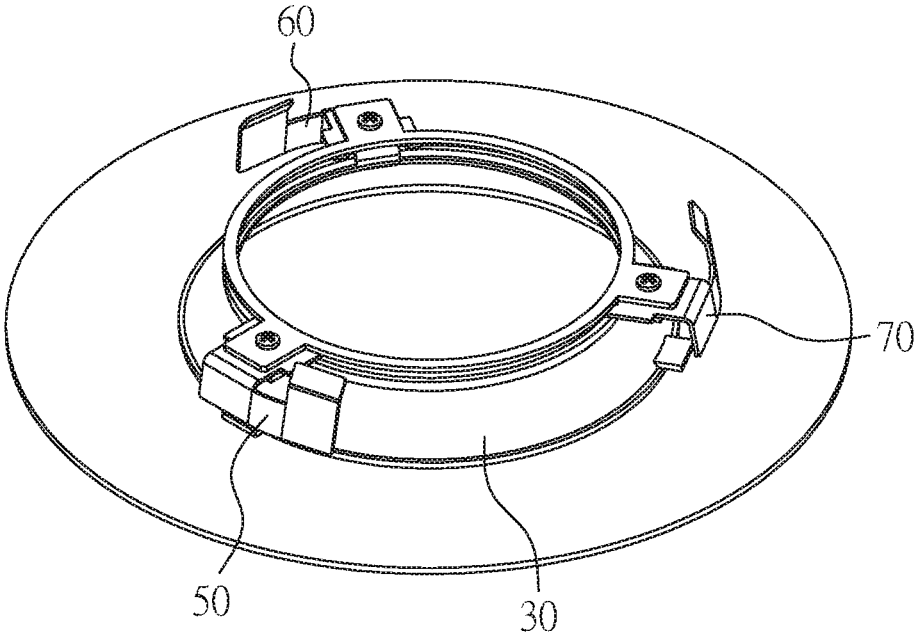
FIG. 6 is a schematic diagram of the trim assembly according to still another embodiment of the invention.

Of course, the spring structure 40 may include more than two contact springs. FIG. 6 is a schematic diagram of the trim assembly 10 according to still another embodiment of the invention. As shown in FIG. 6, the trim assembly 10 includes three contact springs. In an embodiment, the contact springs are disposed at symmetrical positions (defined around a circle), which means any two adjacent contact springs are separated in same distance (or arc length, defined around the circle), but not limited thereto. It is noted that, the number of the contact springs can be added according to the weight of the engaged assembly or a user's requirements.

In conclusion, the invention provides a novel contact spring having an improved abutment. When being used in the same engaged assembly, and providing the same abutment, the invention only needs a less number of the contact springs in comparison with the conventional product (i.e. the typical spring), and thus reduces the cost of manufacturing the contact springs. Besides, because of the novel structure of the contact spring according to the invention, the trim assembly mounted in the engaged assembly can be removed easily by rotating the trim assembly, thereby improving use convenience and safety.

Although the present invention has been explained in relation to its embodiments, it is to be understood that many other possible modifications and variations may be made without departing from the spirit and scope of the invention as hereinafter claimed.

What is claimed is:

1. A trim assembly, adapted to be mounted in an engaged assembly, comprising:

a spring fixing part; and a first contact spring connected to the spring fixing part and adapted to abut on an inner wall of a containing part of the engaged assembly, the first contact spring comprising:

a connecting part connected to the spring fixing part;

an abutting part bending from a terminal of the connecting part and extending to form a first abutting face, wherein the abutting part comprises an end terminal bending part bending towards the spring fixing part from an end terminal of the abutting part; and an extending arm having a second abutting face extending from a side of the first abutting face, wherein the second abutting face extends along a horizontal direction and comprises a smooth face.

2. The trim assembly of claim 1, wherein a first angle is formed between the connecting part and the abutting part, and a degree of the first angle is related to a frictional force between the first contact spring and the inner wall.

3. The trim assembly of claim 1, further comprising a second contact spring disposed on the spring fixing part and contacting the inner wall, wherein a structure of the second contact spring corresponds to that of the first contact spring.

4. The trim assembly of claim 3, wherein when the first contact spring and the second contact spring are connected to the spring fixing part, a position of the first contact spring on the spring fixing part and a position of the second contact spring on the spring fixing part are symmetrical to each other.

5. The trim assembly of claim 4, wherein the extending arm of the first contact spring and the extending arm of the second contact spring extend along opposite directions.

6. The trim assembly of claim 4, wherein the extending arm of the first contact spring and the extending arm of the second contact spring extend along a same direction.

7. The trim assembly of claim 1, wherein the first contact spring is made of an elastic material, and when the trim assembly is mounted in the engaged assembly, a free space exists between the extending arm and the spring fixing part.

8. The trim assembly of claim 1, wherein the trim assembly is applied to a lighting fixture.

9. A spring structure for a trim assembly adapted to be mounted into a containing part of an engaged assembly, the spring structure comprising:

a first contact spring adapted to abut on an inner wall of the containing part, the first contact spring comprising:

a connecting part connected to a spring fixing part of the trim assembly;

an abutting part bending from a terminal of the connecting part and extending to form a first abutting face, wherein the abutting part comprises an end terminal bending part bending towards the spring fixing part from an end terminal of the abutting part; and an extending arm having a second abutting face extending from a side of the first abutting face, wherein the second abutting face extends along a horizontal direction and comprises a smooth face.

10. The spring structure of claim 9, wherein a first angle is formed between the connecting part and the abutting part, and a degree of the first angle is related to a frictional force between the first contact spring and the inner wall.

11. The spring structure of claim 9, further comprising a second contact spring disposed on the spring fixing part and contacting the inner wall, wherein a structure of the second contact spring corresponds to that of the first contact spring.

12. The spring structure of claim 11, wherein when the first contact spring and the second contact spring are connected to the spring fixing part, a position of the first contact spring on the spring fixing part and a position of the second contact spring on the spring fixing part are symmetrical to each other.

13. The spring structure of claim 11, wherein the extending arm of the first contact spring and the extending arm of the second contact spring extend along opposite directions.

14. The spring structure of claim 11, wherein the extending arm of the first contact spring and the extending arm of the second contact spring extend along a same direction.

15. The spring structure of claim 9, wherein the first contact spring is made of an elastic material, and when the trim assembly is mounted in the engaged assembly, a free space exists between the extending arm and the spring fixing part.

16. The trim assembly of claim 9, wherein the trim assembly is applied to a lighting fixture.

* * * * *